United States Patent [19]

Shinoda et al.

[11] Patent Number: 4,697,123

[45] Date of Patent: Sep. 29, 1987

[54] GAS DISCHARGE PANEL

[75] Inventors: Tsutae Shinoda, Akashi; Yoshinori Miyashita, Himeji; Yoshimi Sugimoto, Akashi; Hideo Sei, Kobe; Shizuo Andoh, Akashi, all of Japan

[73] Assignee: Fujitsu Limited, Kawasaki, Japan

[21] Appl. No.: 319,404

[22] Filed: Nov. 9, 1981

[30] Foreign Application Priority Data

Nov. 19, 1980 [JP] Japan ..... 55-163712

[51] Int. Cl.[4] ..... G09G 3/10

[52] U.S. Cl. ..... 315/169.4

[58] Field of Search ..... 315/169.4

[56] References Cited

U.S. PATENT DOCUMENTS 3,665,238 5/1972 Van Esdonk et al. ..... 315/169.4

3,886,390 5/1975 Maloney et al. ..... 313/217

*Primary Examiner*—Robert E. Wise

*Attorney, Agent, or Firm*—Staas & Halsey

[57] ABSTRACT

Disclosed here is a panel structure for a large size display which utilizes the gas discharge panel called the surface discharge type panel. Among a pair of substrates arranged face to face in order to define the gas discharge space, the one substrate which is used as the electrode supporting substrate is composed of the composite substrate body where plurality of small size substrates which can be produced comparatively easily with high production yield are combined in such a form that the side edge surfaces of said substrates are aligned face to face, while the other substrate which is used as the covering substrate is composed of a large size single substrate in such a size same as said composite substrate body. Such substrate structure realizes a large size gas discharge panel having a high production yield, without requiring the large scale production facility.

13 Claims, 12 Drawing Figures

GAS DISCHARGE PANEL

BACKGROUND OF THE INVENTION

1. Field of the Invention

This invention relates to a display panel utilizing gas discharge, particularly to a new large size panel structure of the surface discharge type, the monolithic type or the planar type gas discharge panel.

2. Description of the Prior Art

The surface discharge type, monolithic type or planar type panel is employed as a kind of gas discharge panel. The gas discharge panel of this type, as is well known, for example, from the U.S. Pat. No. 3,646,384 issued Feb. 29, 1972 to Frank M. Lay, provides the characteristic that the X electrodes and Y electrodes are laid only on one substrate of a pair of substrates arranged face-to-face via the gas filled space, and that the horizontal discharge is generated along the substrate surface in the area near to the intersecting points of the electrodes. Such a structure provides the advantages that the requirement of accuracy for the gap between paired substrates (discharge gap) is drastically alleviated as compared with the panel having the face-to-face electrode structure, and moreover conversion of display color and multi-coloration can be realized easily by providing the ultra-violet rays activation type fluouresecent material at the internal side of a covering substrate. Recently, it has become desirable for the display device utilizing such a gas discharge panel to display large size images and figures and a large amount of characters and therefore the pertinent panel must be increased in size. On the occasion of producing such a large size display panel, the surface discharge panel provides the advantage, as explained above, that panels having uniform discharge characteristics can easily be obtained depending on the flatness of the glass substrate used because high discharge gap accuracy is not required. But even this surface discharge panel has a problem in that the probability of generating electrode disconnection and termination of electrodes on the substrate becomes high as the panel size is enlarged and resultingly the number of electrodes is increased. As a result, the yield of panel production is drastically lowered. In addition, such a panel has a problem in that a large scale facility is required for formation of electrodes.

On the other hand, an ordinary gas discharge panel of the face-to-face electrode type, as shown in U.S. Pat. No. 3,886,390 and Japanese Examined Patent Publication No. 55-10197 has a large size display surface by combining a plurality of small size discrete panels, each being completed assembly. However, such a well known panel having a large size display structure cannot be free from the generation of a discontinuous display at the joint areas between adjacent panels.

SUMMARY OF THE INVENTION

It is an object of the present invention to provide a gas discharge panel which realizes a large size display panel assuring simplified production process and high production yield without requiring a large scale production facility.

It is also an object of the present invention to provide a gas discharge panel having a large size display panel which realizes color conversion and multi-coloration.

Briefly, the gas discharge panel of the present invention comprises a plurality of electrode supporting substrates which support electrode pairs of a specified pattern and which are combined in such a form that the side edge surfaces of the pertinent substrates arranged, face-to-face, and a single large size covering substrate are arranged face-to-face at the upper side of this combined substrated enclosing a specified gas discharge space. Within the gas discharge space, a fluorescent material is provided as required, opposite the electrode pairs to obtain the desired display color.

Further features and advantages of the present invention will be apparent from the following description with reference to the accompanying drawings.

DESCRIPTION OF THE PREFERRED EMBODIMENTS

Figure 1:
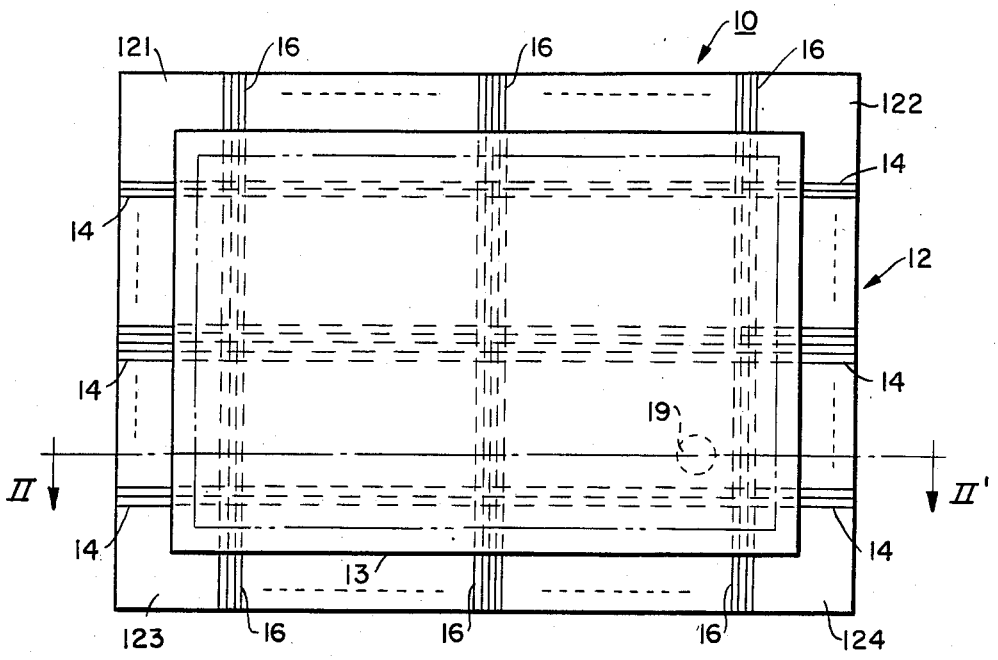
FIG. 1 is a plan view of the structure of the surface discharge type gas discharge panel of the present invention.
Figure 2:
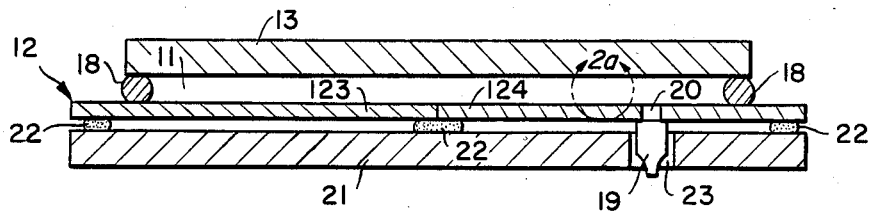
FIG. 2 is a sectional view along the line II—II' of FIG. 1.

In FIG. 1 and FIG. 2, a display panel 10 basically comprises a flat type hermetically sealed body including a pair of large size glass substrates 12 and 13 which are combined face-to-face, enclosing a discharge gas space 11. The upper glass substrate 13 functions as a cover substrate having a single plate structure. The lower glass substrate 12 functions as an electrode supporting substrate having a structure of four sheets of glass substrates 121, 122, 123, 124, each having a size, for example, of $20\times20=400$ cm$^2$ and being combined with two adjacent side edges aligned face-to-face respectively. For the convenience of explanation, substrate 12 is called hereafter the combination substrate.

The four glass substrates 121, 122, 123, 124 have respectively, a plurality of Y electrodes 14, extending in the horizontal direction, and a plurality of X electrodes 16 extending in the vertical direction, respectively positioned below and above an evaporated insulating film 15 (FIG. 2*a*) comprising borosilicate glass. On the X electrodes 16, the dielectric layer 17 comprising borosilicate glass or evapoated film such as aluminium oxide etc., is provided and it is covered with a surface layer of an evaporated film of magnesium oxide ($M_gO$) (not illustrated). One end of the Y electrode group and one end of the X electrode group of each substrate is aligned so that the pertinent corresponding electrodes are arranged in a line bridging over two adjacent substrates as indicated below. The other ends of the respective electrodes are exposed to the outside so that they become the connecting terminals of an external drive circuit.

The X electrodes and Y electrodes on the two sheets of substrate arranged in the same line can be used, respectively, as a single X electrode and a single Y electrode when they are electrically connected at the inside or the outside of the panel, or they can be used as an electrode having an independent function. The Y and X electrodes, 14 and 16 are formed by the patterning of the evaporated conductive layer comprising Cu-Al alloy etc. via a photo-exposing method.

In addition, a seal material 18 comprising a low melting point glass etc. is provided at the circumference between the cover glass substrate 13 and the combination substrate 12. A mixed gas of Xe-He is supplied through a chip pipe 19 and an exhaust port 20 and fills the sealed gas space 11.

Meanwhile, a large size supporting substrate 21 for reinforcing the panel is arranged at the lower side of the combination substrate 12. A low melting point glass 22 is used for bonding purposes. This glass is provided at the circumference and at the corresponding aligning portions of the electrode supporting substrates 121 to 124 positioned on the supporting substrate 21. The bonding material 22 also provides the junction for combining the four sheets of electrode supporting substrates and the bond between the pertinent combination substrate 12 and supporting substrate 21. Here 23 is the through hole for accepting the chip pipe 19. A method of assembling such a large size display panel will be explained briefly as an example.

First, four sheets of electrode supporting substrates 121, 122, 123, 124 which are produced individually are put on the supporting substrate 21, which already has the bonding material 22 at the specified positions, with adjacent side edge surfaces aligned face-to-face. At this time, the aligning portion of each of the four sheets of electrodes supporting substrates is located on the bonding material 22, and the chip pipe 19 is provided in the hole 23. Thereafter, the sealing material 18 and an adequate spacer (not illustrated) are provided on the four sheets of electrode supporting substrate, namely on the combination substrate 12, and then the covering glass substrate 13 is provided thereon. When adequate pressure and heat are applied to this stacked body structure, the bonding material 22 and sealing material 18 are respectively melted, thereby bonding (junction) the pertinent substrates and sealing the gas space 11. Thereafter, the discharge gas is supplied into the gas space 11 through the chip pipe 19, thereby completing the desired large size surface discharge type gas discharge display panel.

Such a large size display panel can be driven as expained below. Namely, the matrix address drive for the entire panel becomes possible by electrically connecting corresponding electrodes on the same line of adjacent sheets of electrode supporting substrates (externally). If the electrodes are not electrically connected between the electrode substrates, a partial matrix address drive for each electrode supporting substrate becomes possible. In the former case, the drive circuit can be simplified and in the latter case, the drive circuit is complicated but high speed addressing can be attained. The basic embodiment of the present invention is explained above but the subject matter of the present invention is not limited to this embodiment and allows for diversified modification and expansion. Some examples of modifications are as follows.

(1) The supporting substrate for reinforcing the panel described above is not always required. However, if it is not used, a thick electrode supporting substrate should be used. In addition, the low-melting-point glass must be provided for bonding purposes at the aligning portion of the substrates (between the side edge surfaces). This bonding structure can also be used when the supporting substrate is used.

(2) The electrodes and dielectric layers can be formed not only by the thin film technique, but also via thick film techniques.

Figure 3:
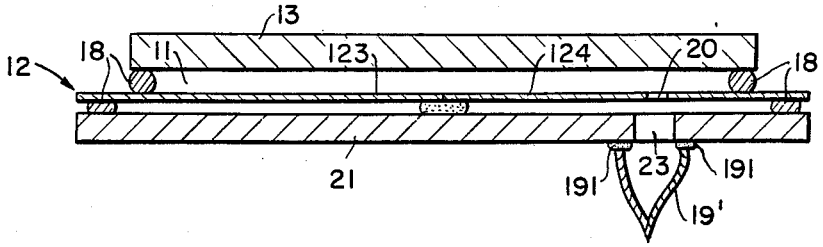
FIG. 3 is a sectional view of a modification of the present invention.

(3) In the case of a panel structure utilizing the supporting substrate 21 for panel reinforcement, a chip pipe 19' can be provided on the supporting substrate 21 as shown in the sectional view of FIG. 3 by hermetically sealing the circumference of the combination substrate 12 to the supporting substrate 21. In FIG. 3, the portion 191 is low-melting-point glass for bonding the chip pipe 19' to the supporting substrate 21. According to this panel structure, the space between the combination substrate 12 and the supporting substrate 21 is set to the same pneumatic pressure condition as the discharge gas filled space 11. Therefore, there is no fear of deforming the combination substrate 12 due to external pneumatic pressures during the baking after exhausting the pressure from the gas filled space 11, or during actual display operation. For this reason, this method has the following merits. The gap in the gas filled space 11 can be kept constant and the weight of the display panel, as a whole, can be reduced because a thin and light weight material can be used for the electrode supporting substrate which forms the combination substrate 12. The practical dimensions for the display can be adopted as follow. The electrode supporting substrate having a size of $20\times20=400$ cm$^2$ requires a thickness of 5 mm for the panel structure shown in FIG. 1 and FIG. 2, but only a thickness of 1 mm in the case of the structure shown in FIG. 3. In the case of employing the chip pipe structure, it is necessary to allow the discharge gas to flow between the pertinent electrode supporting substrates and the supporting substrate by providing a gas route through the bonding material 22, which realizes the joint between the aligning portions of the electrode supporting substrates. Moreover, the circumference of the panel must be sealed under the condition that the side edges of the electrode supporting substrates are hermeticlly sealed, and in this case more reliable sealing between the electrode supporting substrate edges can be obtained because the electrode supporting substrate is thinner. However, it is not necessary to consider the sealing between the electrode supporting substrates when using the structure, where the supporting substrate 21 and the circumference of the cover substrate 13 are directly sealed, and the combination substrate 12 is installed with an air-tight space therebetween.

(4) The number of electrode supporting substrates combined is not limited to four, as in the above example, more substrate sheets can be used.

Figure 4:
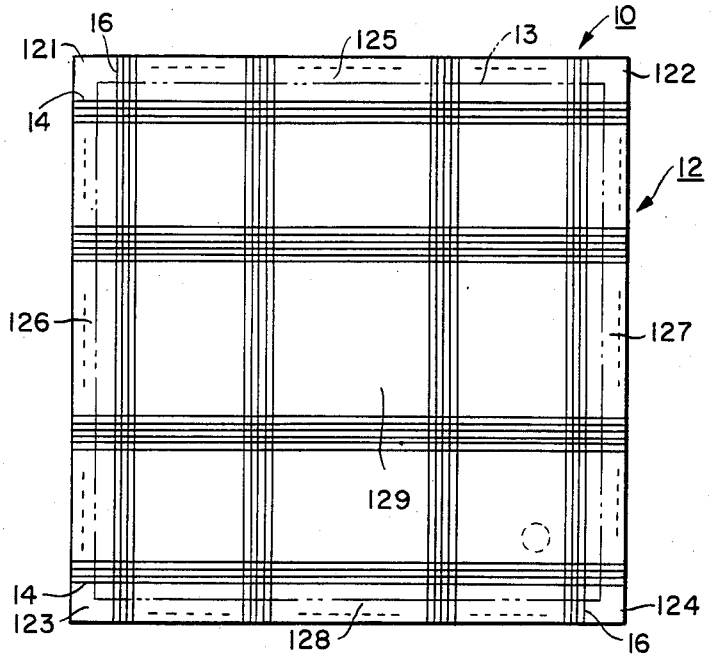
FIG. 4 is a plan view of a panel in accordance with a modification of the present invention having nine sheets of electrode supporting substrates combined in a three by three arrangement.

FIG. 4 shows an example where nine substrate sheets are combined in a three by three manner. In this case, the electrodes of five substrate sheets 125, 126, 127, 128, 129, framed by four sheets of square substrates 121, 122, 123, 124, are subjected to the following wire processing.

Recommended as the first method, is that corresponding electrodes located on the same line bridging over adjacent substrates be electrically connected via connecting wires by the well known bonding technique under the condition that these substrates are arranged face-to-face.

Figure 5A:
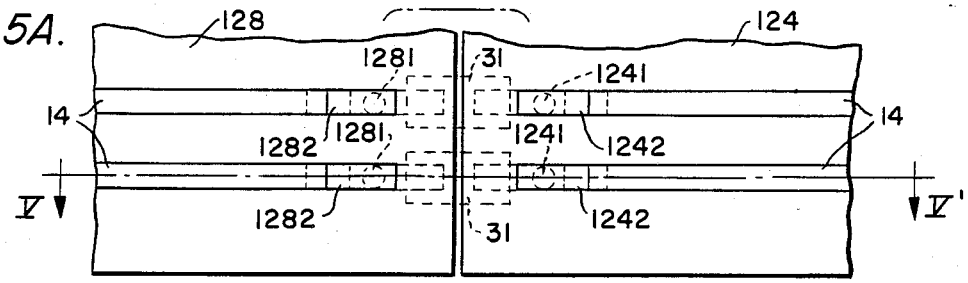
FIGS. 5A and B are a plan view and a sectional view, respectively, of the electrode connecting structure for obtaining continuity of electrodes of adjacent electrode supporting substrates.
Figure 5B:
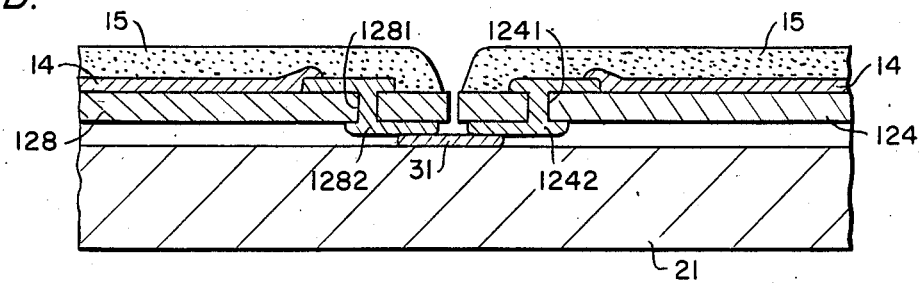

As the second wiring method, the wiring shown in FIG. 5 A and FIG. 5 B is recommended. Namely, FIG. 5 A is a plan view of a major portion indicating the connecting structure for corresponding Y electrodes 14 on the same line of two adjacent sheets of electrode supporting substrates 124 and 128, shown arranged in the horizontal direction of FIG. 4. FIG. 5 B is a sectional view along the line V—V of FIG. 5 A. In these figures 1241 and 1281 are through holes; 1242 and 1282 are electrode leadout conductors; 31 is the electrode connecting conductor. In this embodiment, it is important that the electrode supporting substrate be easy to manufacture and have a high melting point. In this example, alumina ceramic is used. In practice, the alumina ceramic substrate has the thickness of 0.6 mm and a size of $20\times20=400$ cm$^2$. At first, a plurality of through holes (1241, 1281) having a diameter of about 0.5 mm are bored by a laser machining technique. These holes are positioned at the edges of the side joining with the other ceramic substrate (electrode substrate). Succeedingly, an Au paste is printed in such a form so as to match the Y electrode pattern respectively on the front and rear surfaces of the ceramic substrates on which the through holes are bored. At the time of printing, since the Au paste flows into the through holes, the printed Au pastes at the front and rear sides of the substrates become continuous, as shown in FIG. 5 B. After printing with this Au paste, the printed Au paste is baked, and thereby electrode leadout conductors (1242, 1282) are formed. Thereafter, an evaporated conductive layer of the Cu-Al alloy is provided in accordance with the Y electrode pattern on the surface of the ceramic substrate, and thus the desired Y electrode (14) is formed. In this case, as shown in FIG. 5, the edge of a Y electrode is stacked at one end of the electrode leadout conductor and electrically connected via the through holes, e.g., 1241. Thereafter, an evaporated film 15 of borosilicate glass is formed on the surfaces of the ceramic substrates. Succeedingly, the X electrodes and its leadout conductor, although they are not illustrated, are formed by the abovementioned production method. The abovementioned electrode supporting substrates (124, 128) are completed through the aforementioned production processes.

Next, the above formed electrode supporting substrates are provided on the supporting substrate 21, used for reinforcement, with the edge surfaces where the electrode leadout conductors (1242, 1282) are formed being aligned face-to-face as shown in FIG. 5 B. But, prior to this placement, the Au paste (31) for connecting the electrode leadout conductors (1242, 1282) are printed at specified positions on the substrate mounting surface of the supporting substrate 21. The electrode leadout conductors (1242, 1282) are positioned closely on the connecting conductor (31). Thereafter, such conductor is baked and melted. Thereby, both conductors (1242, 1282) are electrically connected via the connecting conductor 31. Using the electrode connecting structure shown in FIG. 5 and explained above, corresponding lines of the Y and X electrodes 14 and 16 on the combined nine sheets of electrode supporting substrates (i.e., 121, 122, 123, 124, 125, 126, 127, 128 and 129) are electrically connected as shown in FIG. 4. Thus, the combined sheets function as the matrix electrode of a large size display panel. The chip pipe structure is not limited to that indicated in this wiring example, but is recommended to have the structure shown in FIG. 3.

Figure 6:
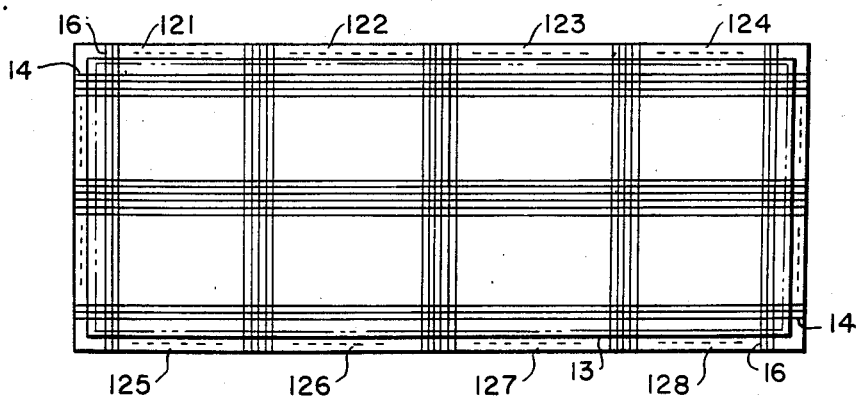
FIG. 6 is a plan view of a panel in accordance with a modification of the present invention where eight sheets of electrode supporting substrates are combined in a two by four arrangement.
Figure 7A:
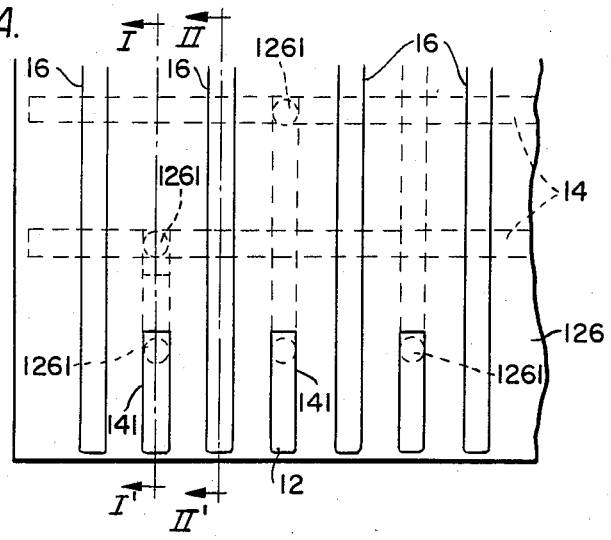
FIG. 7A is a plan view of the electrode leadout structure which is effective when combined with the embodiment of FIG. 6.
Figure 7B:
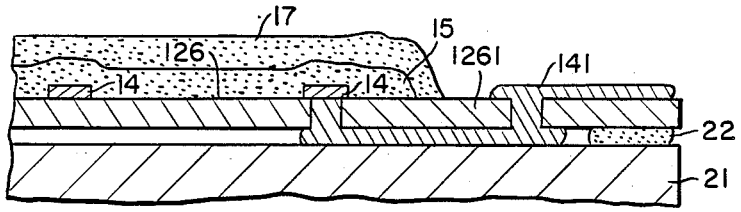
FIGS. 7B and 7C are sectional views of the electrode leadout structure which is effective when combined with the embodiment of FIG. 6.
Figure 7C:
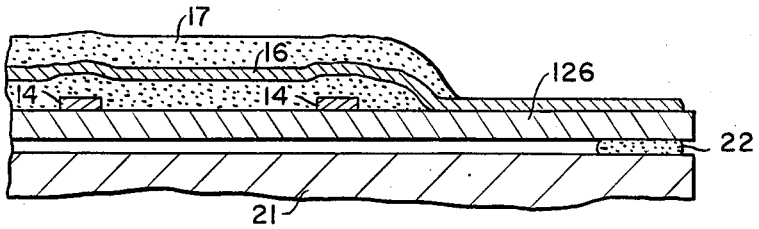

The third wiring method effective for producing a rectangular large size display panel, comprises combined electrode supporting substrates arranged in two vertical columns as shown in FIG. 6, will be explained. Namely, this method is characterized in that the electrode supporting substrates 121, 122, 123, 124, 125, 126, 127 and 128 are independently driven to obtain a high quality display with a uniform operating margin of the electrode supporting substrates. In more concrete terms, the external connecting terminals of the X electrodes and Y electrodes are guided out from the remaining one side of each of the central four electrode supporting substrates 122, 123, 126, 127 which have three sides arranged face-to-face as shown. FIG. 7 A shows the plan view of the principal portion of the electrode supporting substrate 126 employing this method. FIG. 7B and C respectively shown sectional view along the lines I—I' and II—II' of FIG. 7 A. In these figures, 1261 is a through hole; 141 is an electrode leadout conductor comprising Au paste for connecting the Y electrode 14 to the external drive circuit.

For the electrode supporting substrates 121 to 128, alumina ceramic material is used, and the through hole (1261) and the electrode leadout conductor (141) of this ceramic substrate are formed by the method shown in FIG. 5.

(5) A larger display panel can also be configured by combining a plurality of large size gas discharge panels shown in FIG. 1, FIG. 4 and FIG. 6. In this case, it is recommended for the method of combining the discrete panels to refer to the method described in the aforementioned U.S. Pat. No. 3,886,390.

Examples of the expansion of this invention are listed below.

(1) Color conversion or multi-color display can be realized by providing the ultra-violet ray activation type fluorescent material, having the specified display color, within the gas filed space of the panel or at the outside of the panel. Three practical examples of providing color will be explained.

Figure 2A:
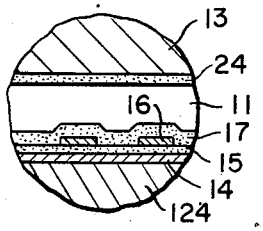

Namely, in the case of the first embodiment, the fluorescent material 24 is provided at the internal surface of the covering glass substrate 13 as shown in FIG. 2*a*. In this case, the fluorescent material having the specified display color is formed on the entire portion of the internal wall of the substrate, provided that the panel is to be a single color display panel or only intended for color conversion. In addition, for a panel intended to be a multi-color display, the fluorescent material which partially shows the display of blue, red and green is provided as required on the internal surface of the substrates, respectively corresponding to the display areas composed of the intersecting points of the Y electrode group 14 and the X electrode group 16. The embodiment shown in FIG. 2 uses the mixed gas of $X_e$ and $H_e$ as the display gas. Therefore $(Y.Gd)BO_3$: Eu is recommended as the fluorescent material for displaying red, while $BaMgAl_{14}O_{23}$: Eu is recommended for displaying blue and $Zn_2SiO_4$: Eu is recommended for displaying green.

Figure 8:
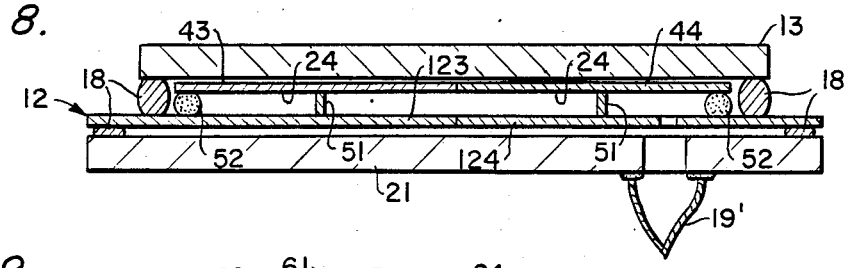
FIGS. 8 and 9 are sectional views of a panel which realized color conversion or multi-color display of the present invention.

In the 2nd embodiment, as shown in the sectional view of FIG. 8, the fluorescent material supporting substrates 41, 42, 43 . . . have a size of $18 \times 18 = 324$ cm$^2$ and a thickness of 1 mm. An equal number of electrode supporting substrates are also combined and arranged in the discharge gas filled space of the panel with the specified gap (0.1 mm) provided between the electrode supporting substrate. The fluorescent material 24 of the fluorescent material supporting substrate can be formed by the procedures explained previously. The portion indicated by 51 is a spacer and reference numeral 52 indicates bonding material. This embodiment provides a significant benefit in that a large scale facility is not required for the processing of the fluorescent material utilized in providing the large size multi-color display panel. As shown in the sectional view of FIG. 9, the third embodiment has a structure such that the large size fluorescent material supporting substrates 61 and the fluorescent material 24 are arranged face-to-face at the external wall surface of the covering glass substrate 13. In short, the fluorescent material is provided at the external side of the panel and in this case sufficent consideration must be paid to the light emitting efficiency of the fluorescent material to prevent optical crosstalk between the light emitting points and to the effects of humidity on the fluorescent material.

Figure 9:
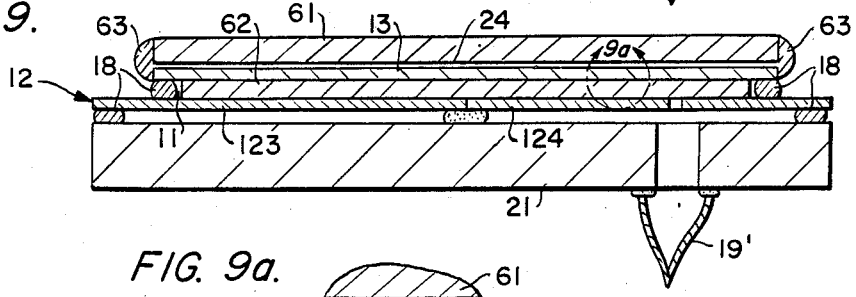
Figure 9A:
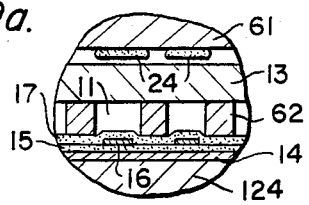

As countermeasures, in the case of this embodiment, from the view point of material, the mixed gas of $Ar + N_2$ is used as the discharge gas, the glass materials of corning 9–54, 9700 produced by Corning Corp. with a thickness of 1 mm is used as the glass substrate for covering. while $YO_sS$: Eu, ZnS: Ag ZnS: Cu-Al may be used as the fluorescent material. Then, from the viewpoint of structure, as shown in FIG. 9, the bored insulating substrate 62 for obtaining independent discharge area is provided in the gas filled space 11. Simultaneously, the circumference of the fluorescent material supporting substrate 61 is sealed by the frit material 63 and dry gas is filled in the sealed space between the substrate 61 and the covering glass substrate 13. For the fluorescent material supporting substrate 61, a comparatively thick glass substrate of 2 mm is used. This thick glass substrate reinforces the covering glass substrate 13 in combination with the bored insulating substrate 62. This embodiment allows the fluorescent material to be provided after completion of the panel, following the assembly of the electrode supporting substrates and the covering of the glass substrates, and resultingly, offers the advantage of increased flexibility in panel construction required to track the demand for color displays. Also since it is only required to provide the pertinent fluorescent material for the completed panel, the production yield of multi-color display panels can be fantastically improved.

Other expansion examples are also listed below.

(2) As the applicable panel, not only the abovementioned matrix type but also the segment type self shift panel can also be used.

(3) As the electrode structure, the matrix type electrode structure proposed in the U.S. Pat. No. 4,164,678 can also be used in addition to the abovementioned double layered structure. This electrode structure will be briefly explained below. The electrode pad has a floating structure which capacitively couples the lower layer electrode (Y electrode) provided at the position near the single side of the upper layer electrode (X electrode) and discharge is caused at the area between the upper layer electrode and the pertinent electrode pad.

As is obvious from above explanation, the present invention is intended to be applied to a surface discharge type gas discharge panel which realizes a large size display panel, and is characterized in that a plurality of small size electrode supporting substrates which can be produced comparatively easily with high production yield are combined in such a form that the side edge surfaces of the substrates are aligned face-to-face and that a single large size cover substrate is arranged face-to-face at the upper part of this combination substrate. Thereby, a large size gas discharge display panel having a high production yield can be produced without requiring a large scale production facility. Moreover, a large size multi-color display panel can be obtained by providing fluorescent material in the gas filled space defined by a pair of substrates arranged face-to-face, or on the external wall surface of the substrate.

The present invention is restricted only by the appended claims.

We claim:

1. A monolithic gas discharge panel, comprising:

a plurality of electrode pairs for receiving a specified voltage and generating surface discharge;

a plurality of electrode supporting substrates each having side edge surfaces and a respective pair of said plurality of electrode pairs arranged on one side thereof in a specified pattern, said supporting substrates being combined such that the side edge surfaces of adjacent ones of said supporting substrates are arligned face-to-face to form a combination substrate with corresponding electrodes on adjacent supporting substrates being electrically connected;

a single cover substrate covering and arranged facing said supporting substrates with specificed gap therebetween to define a space for gas discharge between them.

2. A monolithic gas discharge panel as claimed in claim 1, further comprising a reinforcing substrate, wherein the combination substrate is supported on the reinforcing substrate.

3. A monolithic gas discharge panel comprising:

a plurality of electrode pairs for receiving a specified voltage and generating surface discharge;

a plurality of electrode supporting substrates each having side edge surfaces and a respective pair of the electrode pairs arranged on one side thereof and in a specified pattern, and being combined such that the side edge surfaces of adjacent ones of said electrode supporting substrates are aligned face-to-face to form a combination substrate with corresponding electrodes on adjacent supporting substrates being electrically connected;

a single cover substrate comprising a light transmissive material covering and arranged facing the electrode pairs arranged on said combination substrate;

a single supporting substrate arranged facing a second side of the combination substrate opposing the one side, with a specified gap therebetween; the circumference of the combination substrate, the cover substrate, and the supporting substrate being arranged face-to-face and being sealed, thus forming two spaces for gas discharge, the gas discharge spaces being mutually connected via a gas route provided on said combination substrate; and a pipe for sealing the discharge gas spaces provided on said supporting substrate.

4. A monolithic gas discharge panel as claimed in claim 1 or 3, wherein the combination substrate comprises four square shaped electrode supporting substrates each having the side edge surfaces of two sides aligned face to face with two of the four square shaped electrode supporting substrates, and wherein each of said square shaped electrode supporting substrates comprises leadout terminals operatively connected to said respective pair of electrode pairs and provided at the remaining two side edge surfaces of respective ones of said electrode supporting substrates.

5. A monolithic gas discharge panel as claimed in claim 1 or 3, wherein said corresponding electrodes of the plurality of electrode pairs being arranged along a line between adjacent ones of said electrode supporting substrates, are connected by lead wires within the gas filled space.

6. A monolithic gas discharge panel claimed in claim 1 or 3, wherein each of the plurality of electrode supporting substrates further comprises:

through holes extending through the substrate and being located adjacent said side edge surface aligned face-to-face;

lead out conductors, each operatively connected to a respective one of said respective pair of electrodes and positioned in a respective one of said through holes; and electrode connecting conductors positioned on said supporting substrate spanning adjacent electrode supporting substrates, and which respectively couple with electrode leadout conductors on said adjacent electrode supporting substrates for electrical connection.

7. A monolithic gas discharge panel as claimed in claim 1 or 3, further comprising:

an insulating layer for insulating said electrodes of each said plurality of electrode pairs;

through holes extending through respective ones of said electrode supporting substrates;

leadout electrodes, each provided on a respective one of said electrode supporting substrates and operatively connected to a repsective electrode of said respective pair of electrodes, and wherein each of said respective pair of electrodes arranged on the electrode supporting substrates comprises an X electrode and a Y electrode arranged orthogonally on opposite sides of the insulating layer, each of the electrode supporting substrates has four sides, of which three sides are located adjacent to the other electrode supporting substrate among the electrode supporting substrates and the remaining side is provided with respective ones of the leadout electrodes, selected ones of said leadout conductors pass through respective ones of the electrode supporting substrates via an associated one of the through holes, extend along the respective ones of the electrode supporting substrates in a direction parallel to the associated X electrode and operatively connect to the associated Y electrode via another associated one of through holes.

8. A monolithic gas discharge panel as claimed in claim 1 or 3, further comprising fluorescent material provided on the surface of the covering substrate facing said electrode supporting substrates.

9. A monolithic gas discharge panel as claimed in claim 1 or 3, further comprising a fluorescent material supporting substrate provided in the gas filled space formed between said specified gap between said combination substrate and said fluorescent material substrate, and wherein said fluorescent material supporting substrate comprises a plurality of substrates, each having side edge surfaces and comprising fluorescent material and being combined with the side edge surfaces aligned facing the side edge surfaces of respective ones of said plurality of substrates.

10. A monolithic gas discharge panel as claimed in claim 9, further comprising insulating spacer material provided between said fluorescent material substrate and said combination substrate and having a thickness equal to said specified gap.

11. A monolithic gas discharge panel as claimed in claim 1 or 3, further comprising fluorescent material provided directly or indirectly on the surface of the covering substrate opposite the surface facing said electrode supporting substrates.

12. A monolithic gas discharge panel as claimed in claim 11, further comprising a fluorescent material supporting substrate having the fluorescent material formed on a major surface, and being arranged facing the surface of the covering substrate opposite the surface facing said electrode supporting substrate and the covering substrate is sealed.

13. A monolithic gas discharge as claimed in claim 11, further comprising an insulating substrate, said insulating substrate having a plurality of holes extending therethrough, a thickness equal to said specified gap and being provided in said gas filled space.

* * * * *

UNITED STATES PATENT AND TRADEMARK OFFICE

CERTIFICATE OF CORRECTION

PATENT NO. : 4,697,123

DATED : September 29, 1987

INVENTOR(S) : Shinoda et al.

It is certified that error appears in the above-identified patent and that said Letters Patent is hereby corrected as shown below:

Front Page, col 2, last line, "12 Drawing Figures" should be --14 Drawing Figures--.

Col. 7, line 31, "covering." should be --covering,--.

Col. 8, line 30, "arligned" should be --aligned--;

line 35, "specificed" should be --specified".

Signed and Sealed this

Twelfth Day of April, 1988

*Attest:*

*Attesting Officer*

DONALD J. QUIGG

*Commissioner of Patents and Trademarks*